US005651299A

United States Patent [19]

Boyle et al.

[11] Patent Number: 5,651,299

[45] Date of Patent: Jul. 29, 1997

[54] METHOD FOR SCORING A TAMPER-INDICATING PLASTIC CLOSURE

[75] Inventors: Kevin Eugene Boyle, Plainfield; Paul William Robbins, Danville; Heinz Otto Gonser, Brownsburg; Peter Steven Miller, Crawfordsville, all of Ind.

[73] Assignee: H-C Industries, Inc., Crawfordsville, Ind.

[21] Appl. No.: 207,943

[22] Filed: Mar. 8, 1994

[51] Int. Cl.[6] ..... B65D 41/34

[52] U.S. Cl. ..... 83/880; 83/38; 83/311; 83/324; 82/47; 82/83; 82/85; 264/154; 413/10

[58] Field of Search ..... 83/880, 38, 54, 83/298, 302, 304, 311, 324; 82/46, 47, 53.1, 83, 85, 1.11; 215/252, 253; 264/154; 425/809; 53/488; 413/10, 15, 17

[56] References Cited

U.S. PATENT DOCUMENTS

| | | | |
|---|---|---|---|
| 3,416,474 | 12/1968 | Musy | 413/10 |
| 3,481,232 | 12/1969 | Yann | 82/85 X |
| 3,481,233 | 12/1969 | Yann et al. | 82/85 |
| 3,673,761 | 7/1972 | Leitz | 215/252 X |
| 3,797,338 | 3/1974 | Molnar | 82/85 X |
| 3,824,941 | 7/1974 | Hannon | 413/10 |
| 3,861,551 | 1/1975 | Hannon | 215/252 |
| 3,951,292 | 4/1976 | Amberg | 215/252 X |
| 4,343,754 | 8/1982 | Wilde et al. | 264/154 |
| 4,418,828 | 12/1983 | Wilde et al. | 215/252 |
| 4,497,765 | 2/1985 | Wilde et al. | 264/268 |
| 4,511,054 | 4/1985 | Shank | 215/252 |
| 4,535,904 | 8/1985 | O'Connor et al. | 215/252 X |
| 4,565,295 | 1/1986 | Mori et al. | 215/252 |
| 4,595,110 | 6/1986 | Herr | 215/252 |
| 4,666,053 | 5/1987 | Corcoran et al. | 215/252 |
| 4,978,017 | 12/1990 | McBride | 215/252 |
| 5,488,888 | 2/1996 | Kowal | 83/880 |
| 5,557,999 | 9/1996 | Smith et al. | 83/880 |

*Primary Examiner*—Rinaldi I. Rada
*Assistant Examiner*—Clark F. Dexter
*Attorney, Agent, or Firm*—Dressler, Rockey, Milnamow & Katz, Ltd.

[57] ABSTRACT

A method and apparatus for vertically scoring a tamper-indicating plastic closure includes a rotatably-driven carousel which includes mandrel assemblies at the periphery thereof. Each mandrel assembly includes a rotatable mandrel on which a respective closure is positioned in operative association, so that the mandrel and closure are moved relative to an associated scoring mechanism. The scoring mechanism includes at least one, and preferably a plurality, of rotatably driven scoring blades, with each blade arranged to engage and cut the pilfer band of a respective closure. Significantly, the system can be operated so as to closely approximate the preferred radial movement of the blade with respect to the closure, thus minimizing "digging" of the scoring blade into the plastic of the closure.

6 Claims, 8 Drawing Sheets

METHOD FOR SCORING A TAMPER-INDICATING PLASTIC CLOSURE

TECHNICAL FIELD

The present invention relates generally to a method and apparatus for scoring and cutting a tamper-indicating plastic closure for a container, and more particularly to scoring a portion of a pilfer band of the closure through use of a servo-driven rotary scoring knife which is operated to closely approximate radially-oriented scoring of the pilfer band.

BACKGROUND OF THE INVENTION

Molded plastic closures such as for use on containers for carbonated beverages and the like have met with extremely widespread acceptance in the marketplace. Commonly-assigned U.S. Pat. Nos. 4,378,893 and No, 4,343,754, disclose closures of this type, and highly efficient techniques for manufacture thereof. U.S. Pat. No. 4,497,765 discloses further techniques for manufacturing such closures, including manufacture of closures each having a tamper-indicating pilfer band. Each of the above-referenced patents is hereby incorporated by reference.

U.S. Pat. Nos. 4,938,370, and No. 4,978,017, both hereby incorporated by reference, each illustrate a plastic closure generally of the above type, with a tamper-indicating plastic band particularly configured for highly reliable and consistent tamper-indication. The pilfer band constructions disclosed in these two patents include pilfer bands which are at least partially detachably connected to an annular skirt portion of the closure, with a plurality of circumferentially spaced, inwardly extending projections provided for engagement with an annular locking ring of an associated container.

For some applications, it is desired that the pilfer band remain on the container after closure removal. To this end, a suitable fracturable connection is provided between the pilfer band and the skirt portion of the closure so that the pilfer band entirely separates from the skirt portion.

In contrast, for some applications (such as for returnable, reusable containers) it is desired that the pilfer band remain partially connected to the skirt portion of the closure, while portions of the band fracturably separate from the skirt portion to provide the desired visible indication of opening. For such applications, it is desirable to form the closure such that at least one portion of the pilfer band splits vertically, with the one or more band segments thus formed remaining joined to the skirt portion of the closure by at least one integral connector portion. U.S. Pat. No. 4,666,053, hereby incorporated by reference, illustrates one embodiment of such a closure, and a method of vertically scoring the closure pilfer band. U.S. patent application Ser. No. 07/958,014, filed Oct. 7, 1992, now U.S. Pat. No. 5,320,234, hereby incorporated by reference, illustrates a presently preferred configuration for such vertical scoring, including a pair of staggered vertical scores.

In practice, vertical scoring requires a sharp scoring blade to penetrate the periphery of the pilfer band of the closure to a precise, controlled depth (or all the way through the pilfer band) and to consistently form a small incision which can be repeatably cut. Experience has shown that the best results are achieved by holding the closure cap motionless on a cylindrical mandrel while moving a radially oriented scoring blade radially into and then out of the closure pilfer band.

In high-speed machinery, however, it is very difficult to have the closure cap remain motionless during scoring blade insertion and removal, especially if the machine is also configured to perform horizontal scoring for otherwise separating and distinguishing the pilfer band from the skirt portion of the closure cap. Moreover, mechanisms in which both the closure cap and the vertical scoring blade are in motion during insertion and removal generally cannot maintain the radial orientation of the blade and/or cannot achieve true radial insertion and removal of the blade. The resultant "digging"(i.e., non-radial) motion of the blade in the plastic can produce unsatisfactory scoring results.

In the above-referenced U.S. Pat. No. 4,666,053, the illustrated arrangement for effecting vertical scoring includes a spring-loaded, pivotally movable scoring blade. The spring-loaded blade is motionless until a closure cap, moving along a circular path, engages the tip of the blade. The moving closure engages and "picks up" the blade, causing it to pivot and score the cap. While the geometry of the blade and associated closure-moving carousel can be arranged to yield optimum blade-to-closure relative motion, the repeatability of the point of blade engagement on the closure is poor, resulting from closure cap and machine dimensional variations. Moreover, at higher speeds, the spring-return oscillating motion of the pivotal scoring blade becomes less repeatable because of bouncing, and variation in the point in which the blade is released to "fly back" to its initial, resting position.

The present invention is directed to a method and apparatus for effecting high-speed scoring, particularly vertical scoring, of a tamper-indicating plastic closure while achieving consistent and precise scoring and cutting of the closure.

SUMMARY OF THE INVENTION

The present invention is directed to a method and apparatus for scoring and cutting a tamper-indicating plastic closure, which in the preferred practice of the invention desirably acts to approximate the preferred radially inward and outward movement of a scoring blade with respect to an associated closure. In accordance with the present invention, high-speed scoring is achieved by a class of mechanisms that can continually move closure caps and vertical scoring blades so as to closely approximate the ideal relative blade-to-closure motion and orientation. In particular, this is achieved through the provision of a rotatable, servo-driven scoring knife, the speed of which is varied during closure scoring to closely approximate radially-oriented cutting.

The present invention is suitable for scoring of plastic closures having a top wall portion, a depending annular skirt portion, and an annular pilfer band. The present scoring apparatus includes a rotatable carousel, and at least one mandrel carried by the carousel so that rotation of the mandrel with the carousel causes the mandrel to further rotate about its own vertical axis with respect to the carousel. This motion is achieved by the provision of a stationary gear with respect to which the carousel rotates, with the mandrel, in turn, driven about its own axis by a spur gear which engages the gear.

For scoring, a closure is positioned in operative association with the mandrel, preferably in coaxial alignment therewith. Rotation of the carousel causes the closure and the mandrel to rotate therewith, with the closure and mandrel further rotating about the vertical axis of the mandrel. Rotation of the carousel facilitates feed and discharge of closures into and from the scoring apparatus, with the further rotation of the mandrel (and closure) about the mandrel axis facilitating high-speed horizontal scoring of the closure as the closure is moved relative to one or more generally fixed, horizontal scoring blades.

In accordance with the present invention, a power-driven vertical scoring mechanism is provided, with the motion of the carousel acting to move the mandrel and closure relative to the scoring mechanism. The scoring mechanism includes at least one, and preferably a plurality, of scoring knives which are power-driven by a servo-drive motor to move with the closure as the closure is moved relative to the scoring mechanism by the associated carousel and mandrel. The one or more scoring knives are preferably rotatably driven about a scoring axis, with the preferred plurality of knives spaced about the scoring axis and rotatably driven thereabout.

The scoring step is preferably effected by positioning the scoring axis (about which the scoring knife rotates) to minimize "digging" of the plastic of the closure, that is, to approximate as closely as possible movement of the scoring blade radially inwardly and outwardly of the plastic closure. Accordingly, the scoring axis is defined by the intersection of: (1) a first line extending through the vertical axis of the closure and a portion of the closure pilfer band at which the scoring knife first engages the closure, and (2) a second line extending through the vertical axis of the closure and that portion of the closure pilfer band at which the scoring knife disengages the closure at completion of the scoring step. In other words, the scoring axis is positioned symmetrically with respect to the point of entry, and point of disengagement, of the scoring knife with respect to the plastic closure.

Notably, a true relatively radial inward and outward movement of the scoring blade with respect to the closure (i.e., moving the scoring knife along the line which intersects the vertical axis of the closure) can most closely be approximated by selectively controlling the speed at which the knife is rotatably driven as the knife moves into, and is withdrawn from the closure generally along the line intersecting with the closure axis. To this end, the rotatable scoring knife is preferably driven by a suitable servo motor which in turn is operated to closely approximate the ideal radial movement of the scoring blade with respect to the closure. In practice, the scoring blade is accelerated, then decelerated, during the actual scoring of the closure.

Other features and advantages of the present invention will become readily apparent from the following detailed description, the accompanying drawings, and the appended claims.

DETAILED DESCRIPTION

Figure 1:
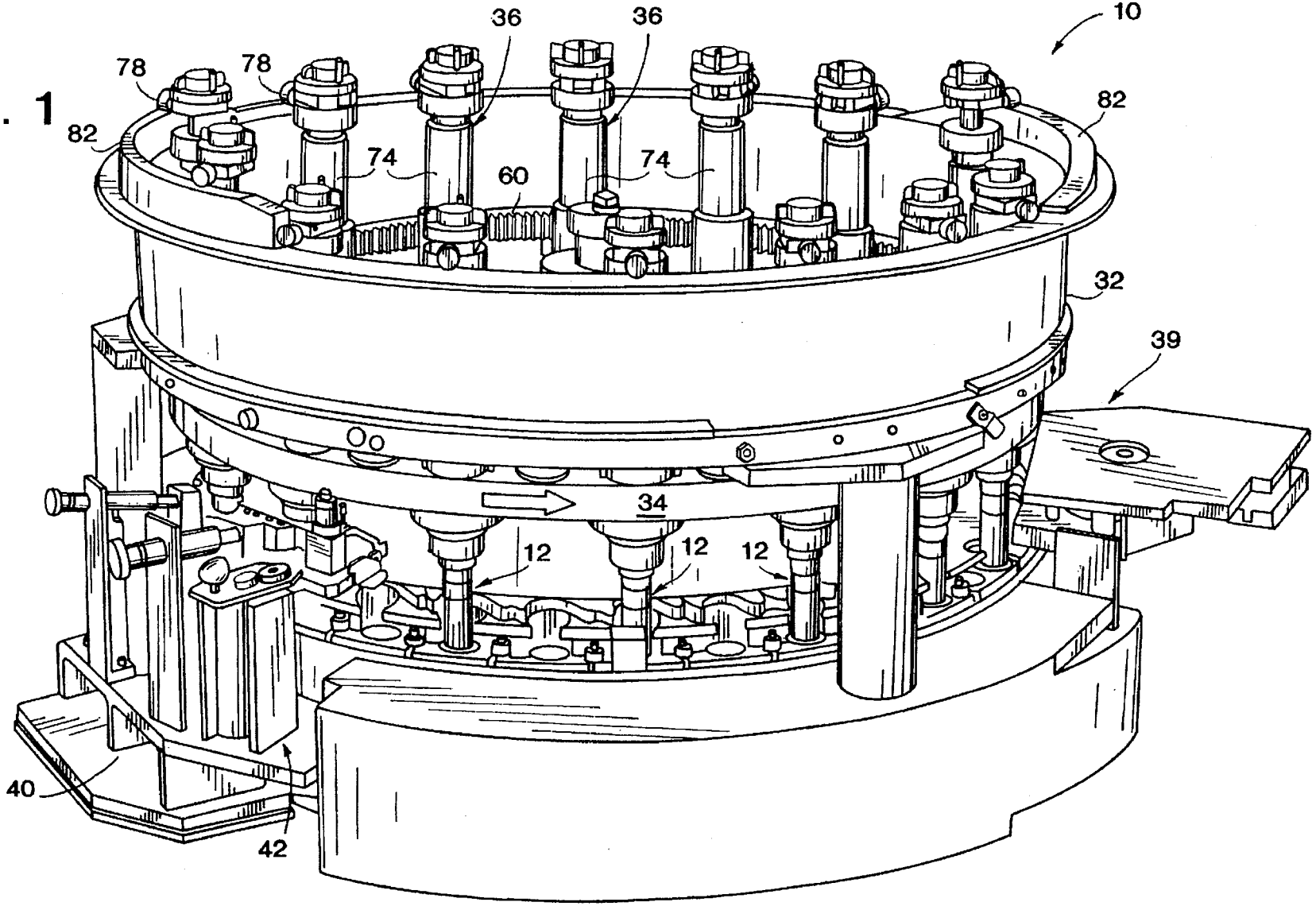
FIG. 1 is a perspective view of a closure scoring apparatus embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

FIG. 1 illustrates a scoring apparatus 10 embodying the principles of the present invention. As will be further described, scoring apparatus 10 is particularly suited for handling molded plastic closures 12 (see FIGS. 9 and 10) during manufacture thereof, and in particular for scoring and cutting such closures whereby a pilfer band of each closure is rendered fracturable and separable from the remaining portion of the closure to provide the desired readily discernable visible evidence of opening.

Figure 9:
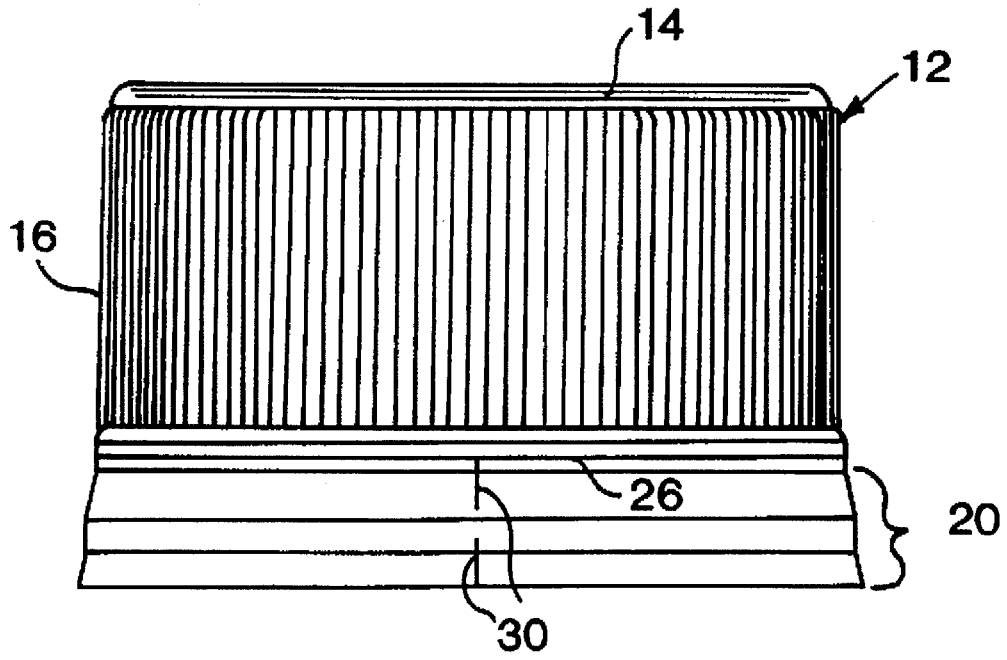
FIG. 9 is an elevational view of a tamper-indicating plastic closure of the type which can be scored in accordance with the present invention.
Figure 10:
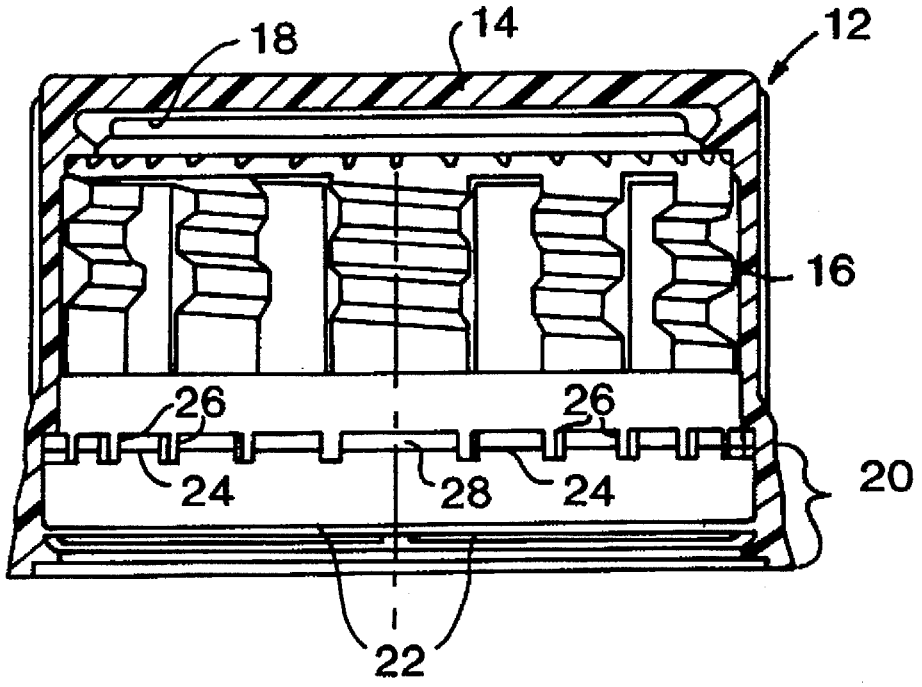
FIG. 10 is a cross-sectional view of the tamper-indicating plastic closure illustrated in FIG. 9.

With reference first to FIGS. 9 and 10, an understanding of the present invention will be facilitated by description of the type of plastic closure 12 for which the present invention is particularly suited for manufacture. Plastic closure 12 includes a top wall portion 14 and an annular, generally cylindrical depending skirt portion 16 having an internal thread formation thereon. A sealing liner 18 can be provided adjacent the top wall portion 14 for providing the desired sealing cooperation with an associated container.

Closure 12 includes a pilfer band 20 configured in accordance with the above-incorporated U.S. Pat. No. 4,938,370. The pilfer band 20 includes a plurality of circumferentially spaced inwardly extending flexible projections 22 which are engageable with an annular locking ring of an associated container. Notably, pilfer band 20 is configured to provide two distinct modes of interfering cooperation with an associated container, thus providing extremely reliable and consistent tamper-indication.

The pilfer band 20 is partially distinguished from the skirt portion 16 of the closure by a circumferentially extending horizontal score line 24. The score line 24 extends substantially through the side of the closure, and partially into a plurality of circumferentially spaced internal frangible bridges or ribs 26. By this construction, each unscored portion of the partially scored bridges 26 provides a fracturable "residual" portion, with these fracturable residual portions collectively detachably connecting the pilfer band 20 to the skirt portion 16. In this embodiment, configured for those applications where it is desired that the pilfer band remain connected to the skirt portion after closure removal, an integral, unscored connector portion 28 is provided which does not fracture during closure removal, thus joining the pilfer band and the skirt portion after fracture of fracturable bridges 26.

In order to facilitate convenient removal of the closure, including partially detached pilfer band 20, from an associated container, it is preferred that the pilfer band 20 fracture and split into one or more band segments. To this end, a pair of vertically spaced vertical scores 30 (FIG. 9) are provided in the pilfer band, with another fracturable residual portion thus defined in the region generally between the vertical scores (see U.S. Pat. No. 4,666,053). In the illustrated embodiment, the vertical scores 30 are positioned in substantially diametrically opposed relationship to the connector portion 28, with the pilfer band 20 thus assuming a "gull wing" like configuration as the band splits at the vertical scores 30 into two band segments extending from respective opposite sides of the connector portion 28. However, the vertical scores can be otherwise situated with respect to the connector portion 28, and more than one portion of the pilfer band can be vertically scored so that the band can split into more than two band segments.

While the present application contemplates formation of one or more vertical scores 30, the scores need not necessarily be truly vertically oriented, that is, parallel to the axis of the closure. For purposes of the present disclosure, the term "vertical" scoring is intended to encompass generally vertical scoring which may be up to 45° from the vertical, since the desired splitting and fracture of the pilfer band will still be achieved.

The illustrated embodiment includes a pair of vertical scores 30 which are substantially vertically aligned. However, the pair of scores can be otherwise oriented, such as in a staggered relationship, as disclosed in U.S. patent application Ser. No. 07/958,014, filed Oct. 7, 1992, now U.S. Pat. No. 5,320,234 hereby incorporated by reference. Additionally, formation of a single vertical score (rather than a pair of closely spaced and cooperating scores, as illustrated), or more than two cooperating scores, can be effected through use of the method and apparatus of the present invention.

It is believed that the desired consistency and resistance to pilfer band fracture (sometimes referred to as "pull strength") is best achieved by consistent formation of the one or more vertical scores 30, preferably by an action which closely approximates movement of a scoring blade radially of the closure cap. The apparatus and method of the present invention are particularly suited for effecting vertical scoring of closure 12 in this fashion, in a high-speed and efficient manner.

With particular reference to FIGS. 1–6, the scoring apparatus 10 includes a frame 32 with respect to which a rotatably driven carousel 34 rotates. The carousel 34 carries a plurality of circumferentially spaced mandrel assemblies 36 positioned generally at the periphery of the carousel, and further carries and rotates a corresponding number of respective closure support assemblies 38. The mandrel assemblies 36 and the support assemblies 38 respectively cooperate for receiving molded closures from an associated supply, and thereafter scoring each closure to render the pilfer band 20 of each closure fracturable for tamper-indication. The closures are thereafter discharged from the apparatus, with the desired scoring being effected attendant to one cycle of revolution of each cooperating mandrel assembly and support assembly about the apparatus 10 by the carousel 34.

Closures are supplied to, and received from, the scoring apparatus at a suitable feed/discharge station 39 (FIG. 1 ). Scoring of the closure is effected by scoring knives mounted at a scoring station 40 (FIG. 1) with the scoring station including a vertical scoring knife mechanism 42 configured in accordance with the present invention for effecting vertical scoring of the pilfer band, such as formation of vertical scores 30.

Figure 2:
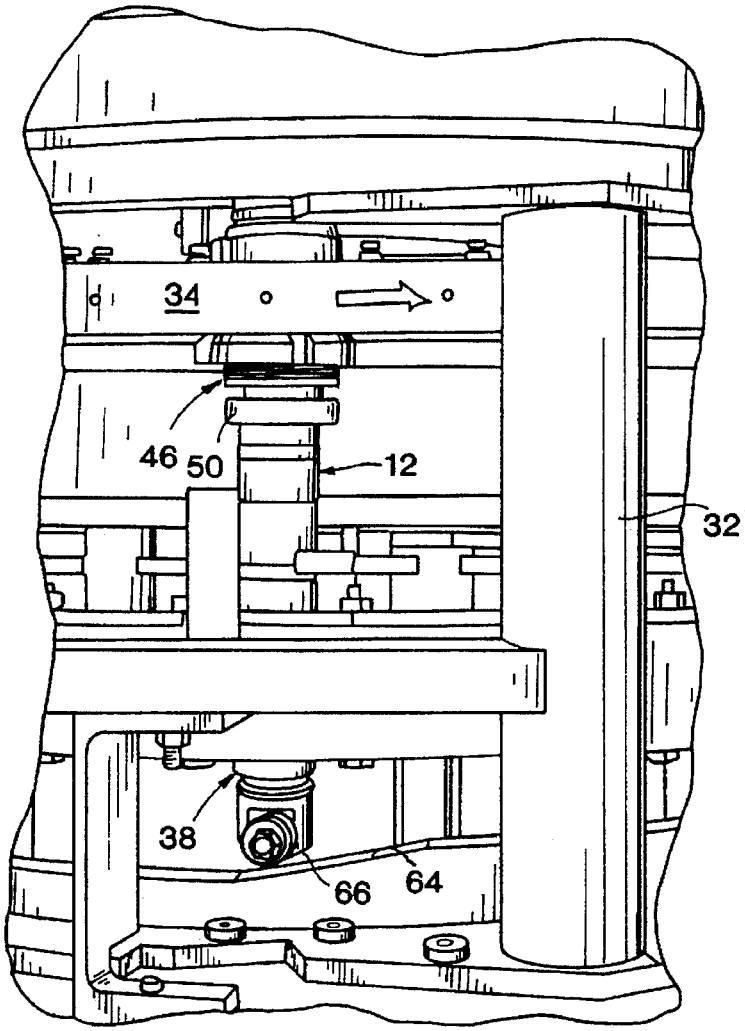
FIG. 2 is a fragmentary perspective view of the scoring apparatus illustrated in FIG. 1.
Figure 3:
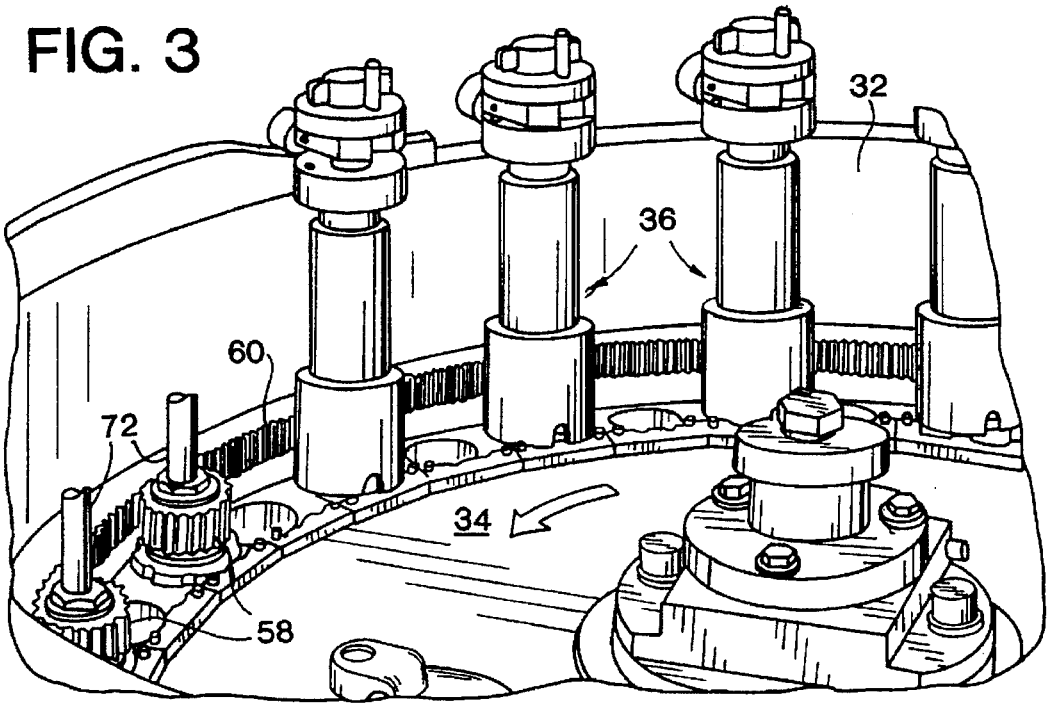
FIG. 3 is a fragmentary perspective view, partially cutaway, of the scoring apparatus illustrated in FIG. 1.
Figure 4:
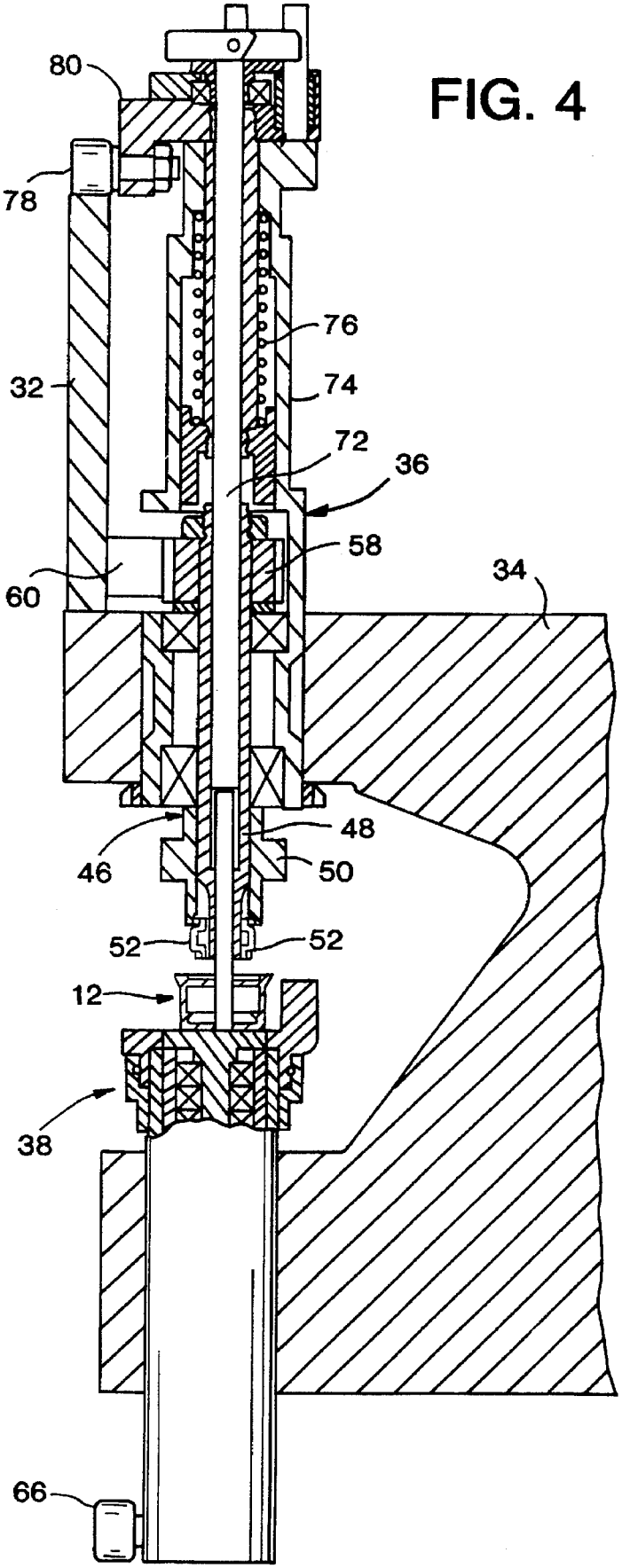
FIG. 4 is a cross-sectional view illustrating mandrel and support assemblies of the present apparatus which are mounted on a rotatable carousel of the apparatus.
Figure 5:
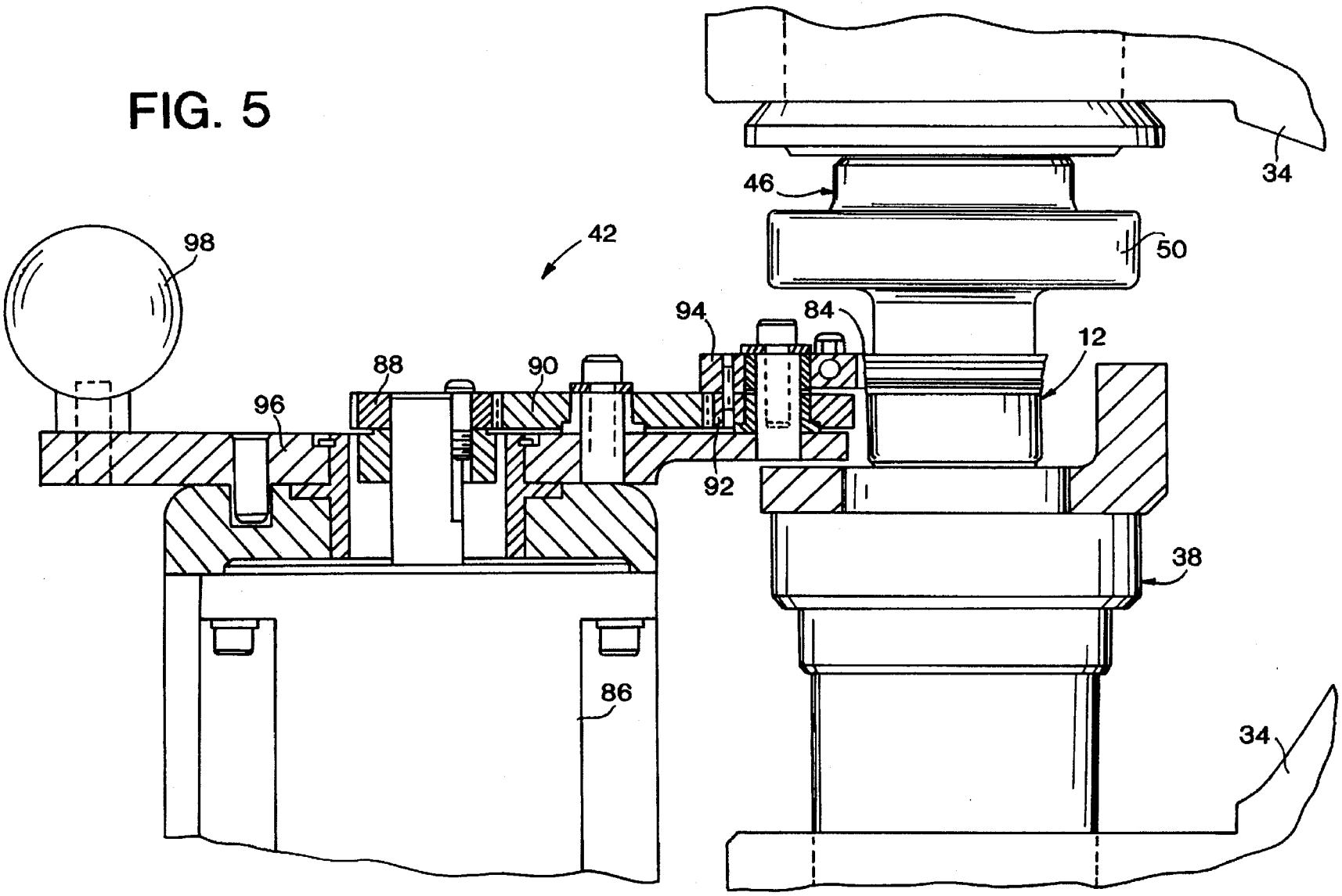
FIG. 5 is a fragmentary, elevational view, in partial cross-section, illustrating a vertical scoring mechanism of the present invention.
Figure 6:
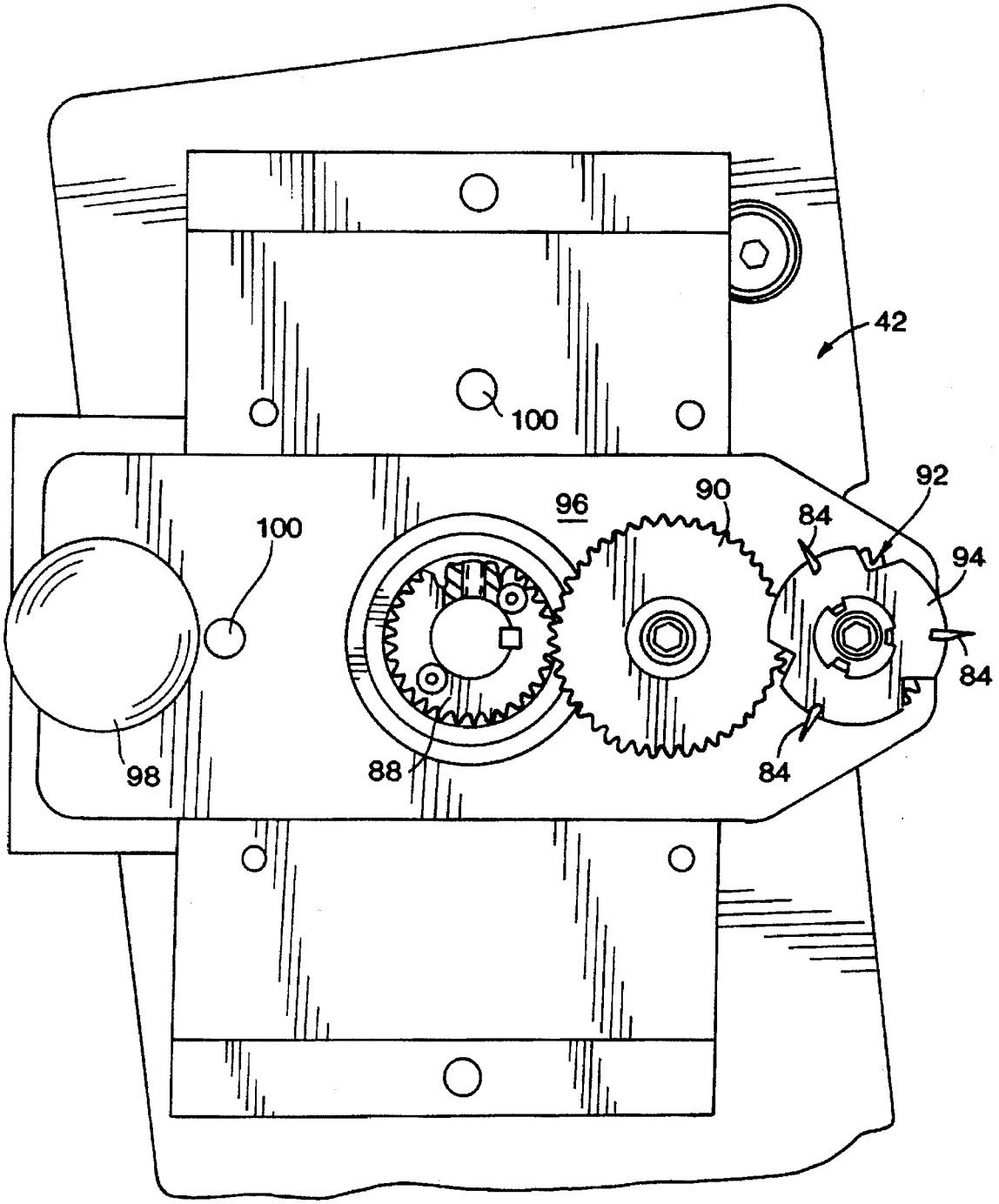
FIG. 6 is a fragmentary, top plan view of the scoring mechanism shown in FIG. 5.

With further reference to FIGS. 2–4, each mandrel assembly 36 includes a rotatable mandrel 46 rotatably mounted on the carousel 34. Each mandrel 46 includes a rotatable mandrel shaft 48, supported by suitable bearings, with an annular support ring 50 mounted generally at the lower end of the mandrel shaft. Each mandrel 46 may further include a pair of spring-biased stop dogs 52 which can be employed for effecting orientation of the closure 12 with respect to the mandrel 46. Commonly-assigned U.S. patent application Ser. No. 08/182,627, filed Jan. 14, 1994, now U.S. Pat. No. 5,557,999, particularly discloses the arrangement for effecting such closure orientation.

As carousel 34 rotates, each mandrel 46, in turn, is rotatably driven about its own axis. To this end, a spur gear 58 is keyed to mandrel shaft 48, with the spur gear 58 of each mandrel assembly in engagement with a stationary gear 60 which extends generally about the periphery of frame 32 of the scoring apparatus 10 (see FIGS. 1 and 3). Rotation of carousel 34 with respect to gear 60 thus acts to rotate each mandrel 46 about its own vertical axis. This driven arrangement of the mandrels 46 facilitates horizontal scoring of the closures, such as for formation of score line 24. In the illustrated embodiment, gear 60 is shown as internally-toothed, but it will be understood that drive of the mandrel assemblies can similarly be effected with an externally-toothed gear.

Each closure 12 is positioned in operative association with a respective mandrel 46, preferably with the mandrel inserted generally within the closure so that the mandrel and closure rotate coaxially together about the vertical axis of the mandrel. In order to position each closure 12 in the desired operative association with a respective mandrel 46, the scoring apparatus includes a lower cam 64 (FIG. 2) mounted on the frame 32 which acts to move each closure upwardly with respect to the vertically spatially fixed mandrel 46.

In operation, the preferred orientation of each closure 12 with respect to its mandrel 46 is effected by relatively rotating the closure with respect to the associated mandrel. To this end, each mandrel assembly 36 includes a vertically movable hold-down plunger 72 arranged coaxially with the respective orientation mandrel 46. Hold-down plunger 72 is vertically movable with respect to an outer casing 74 of the mandrel assembly 36, with each hold-down plunger urged toward the position illustrated in FIG. 4 by compression spring 76 of the mandrel assembly. Upward movement of the hold-down plunger, in opposition to the compression spring 76, is effected via an upper cam follower 78, mounted on a follow arm 80 operatively connected to the hold-down plunger 72, with a pair of upper cams 82 mounted on the frame 32 (see FIG. 1) effecting vertical movement of each holddown plunger 72.

During a cycle of operation of the present apparatus, a closure is introduced into the apparatus at feed/discharge station 39. The closure is received on closure support assembly 38, and hold-down plunger 72 of the respectively associated mandrel assembly 36 is lowered into the closure and into engagement with the inside surface of the top wall portion 14. FIG. 4 generally illustrates this condition of the closure within the apparatus. During this portion of the cycle, the hold-down plunger, under the influence of its compression spring 76, urges the plunger against support assembly 38. The closure is thus held against rotation relative to mandrel 46, which is being rotatably driven by virtue of engagement of its spur gear 58 with gear 60 as the mandrel assembly is moved by the carousel 34.

Support assembly 38 is raised by the action of cam follower 66 against lower cam 64, raising the closure toward and onto the mandrel 46. As the closure is raised, in opposition to spring-biased hold-down plunger 72, the closure is moved into operative association with the mandrel, with spring-biased stop dogs 52 urged inwardly as they engage the projections 22 of the closure pilfer band 20. The closure is subject to limited relative rotation, with respect to the mandrel, whereupon the stop dogs engage the projections 22 of the pilfer band, stopping such relative rotation of the closure and the mandrel. Orientation of the closure with respect to the mandrel is effected in this manner.

Now that the closure 12 is positioned on the mandrel 46, and rotating coaxially therewith as spur gear 58 is rotated along gear 60 by movement of carousel 34, it is preferred that the hold-down plunger 72 be moved upwardly to relieve its frictional engagement with the closure cap, and thus prevent undesired deformation of the cap since it no longer needs to be held against rotation together with the mandrel 46.

During scoring of the closure, it is preferred that the closure be held against rotation relative to the mandrel, thus rotating with the mandrel during scoring. Accordingly, the closure support assembly 38 is moved upwardly relative to the mandrel 46 by action of lower cam 64, thus urging the closure 12 upwardly so that its pilfer band is moved to extend about support ring 50 of the mandrel. During this action, the stop dogs are moved to a position generally beneath the pilfer band projections 22, and therefore no longer act to stop relative rotation of the closure and mandrel. The preferably spring-biased support assembly 38 urges the closure against the face of the mandrel 46 (which may be provided with suitable gripping projections) to hold the closure against rotation relative to the mandrel during scoring. Because the spring-biased surface of the support assembly 38 which engages the top wall portion 14 is rotatably mounted, this surface rotates with the closure, and the mandrel 46, as they are driven via the spur gear 58 and gear 60 by the rotating movement of carousel 34.

As the closure 12 is moved past the scoring station 40, one or more horizontal scoring knives form horizontal score 24, with the one or more vertical scoring knives of the vertical scoring mechanism 42 effecting vertical scoring of the pilfer band, as will be further described. Support ring 50 of the mandrel provides a "reference" surface against which the scoring knives may be urged, thus controlling the depth to which the closure is scored. After scoring, the support assembly 38 is lowered, and hold-down plunger 72 released (by movement of upper cam follower 78 off of the upper cam 82) so that the closure is pushed off of the mandrel 46, and discharged from the scoring apparatus at feed/discharge station 39.

In accordance with the present invention, vertical scoring of the closure at vertical scoring mechanism 42 is preferably effected in a manner to facilitate high-speed operation, and to this end, the scoring mechanism includes at least one, and preferably a plurality, of rotatably driven scoring knives. Significantly, as will now be described in detail, the scoring mechanism 42 is arranged and operated so that the action of each scoring knife closely approximates the ideal scoring action, that is, moving radially inwardly and outwardly of an associated closure, even though the closures are being moved relative to the scoring mechanism by the rotatably driven mandrels 46 carried by carousel 34.

For purposes of this disclosure, reference will be made to a plurality of individual vertical scoring blades, but it is to be understood that each such blade can be provided with one, two, or more cutting edges. Thus, each individual blade can be configured to simultaneously form two scores, such as the pair of staggered vertical scores 30 illustrated in FIG. 9.

Figure 7:
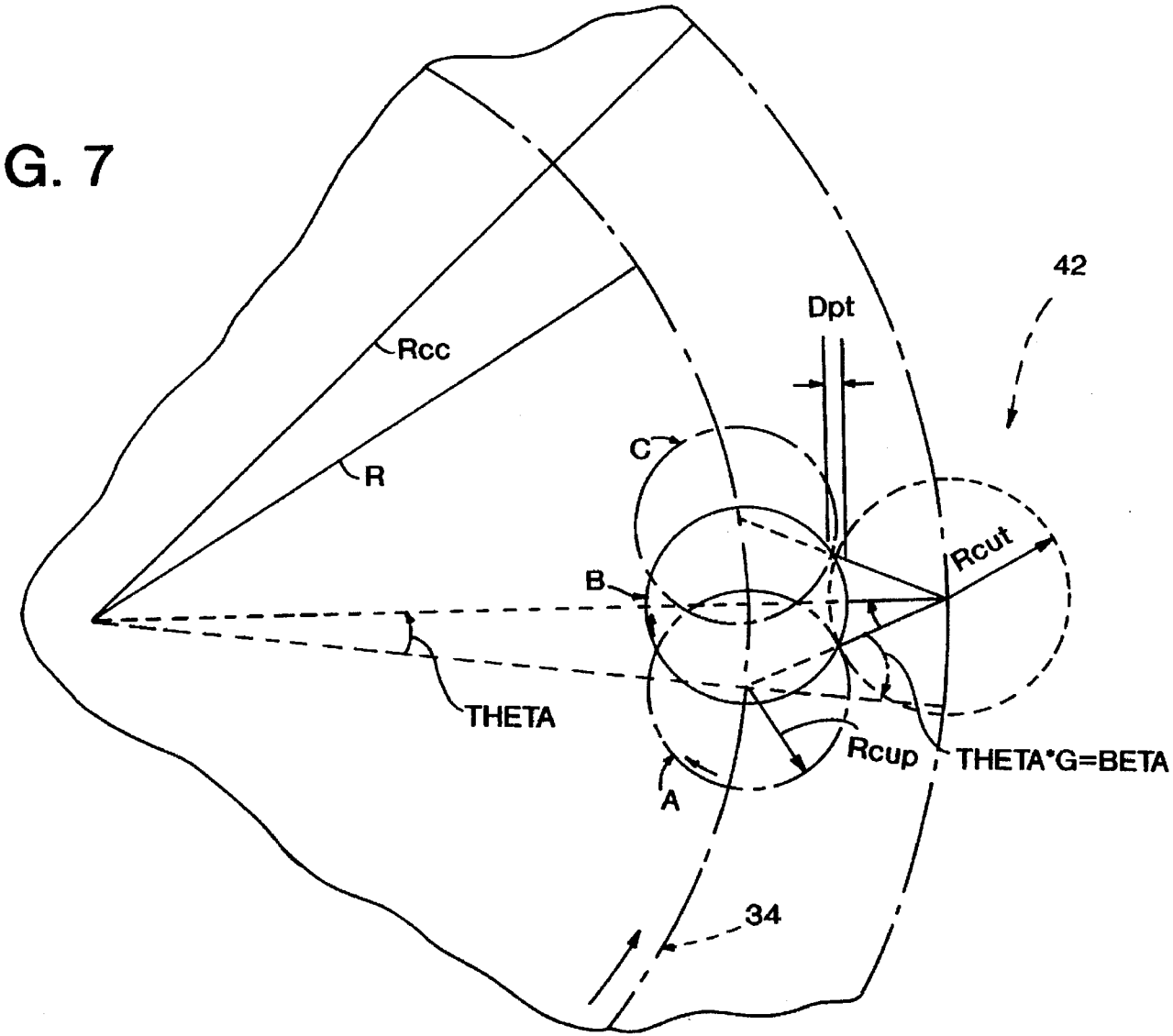
FIG. 7 is a diagrammatic view illustrating operation of the present scoring apparatus, and orientation of the components thereof.

FIG. 7 diagrammatically illustrates the relative movement of a closure and one of the scoring knives of scoring mechanism 42. Closures on the mandrels 46 move in a circular path on the carousel 34 about a radius R. At the same time, the mandrels 46 (driven by the respective spur gears 58) rotate about their own axes at a rate proportional to the rotational speed of the carousel. At the vertical scoring mechanism 42, located along the periphery of the carousel 34 in the scoring apparatus 10, a scoring knife rotates about a pivot or rotational axis located at a distance $R_{cc}$ from the center of the carousel 34. The ratio of the closure's rotational speed about its own axis and the rotational speed of the carousel is chosen so that each closure arrives at position A with one of the points suitable for vertical scoring lying on the line extending between the vertical axis of the cap and the axis about which the scoring blade rotates. The ratio of the closure and carousel rotational speeds may be constrained by requirements of horizontal scoring, i.e., the required travel of the periphery of the closure as it passes the stationary blades of the horizontal scoring station, at 40.

With the ratio of the closure and carousel rotational speeds established, and the radius of the path of the mandrels'centers, R, set, there is an optimal value for the distance from the center of the carousel to the scoring blade pivot, $R_{cc}$. At this value of $R_{cc}$, as the carousel and closure rotate, the blade most nearly remains pointed at the closure's center or vertical axis while pointing at the initial entry point on the periphery of the cap. Again, the desired cutting action approximates radial movement of the scoring blade with respect to the closure. Thus, the axis about which the blade rotates is defined by the intersection of: (1) a first line extending through the vertical axis of the closure and the portion of the closure first engaged by the blade, and (2) a second one extending through the vertical axis of the closure and that portion of the closure at which the blade disengages the closure at completion of scoring.

During the actual scoring interval, as the closure passes from position A, through center position B, and to position C, the angular speed of the carousel is constant and the angular speed of the closure is also constant. However, the angular speed of the scoring blade needed to follow the initial entry point is not quite constant. It is not practical to design a system such that the angular speed of the scoring blade is constant and equal to the average of the angular speed during the scoring interval, because of the above-described design constraints, and because the number of scoring blades employed must be a positive integer.

Therefore, in accordance with the present invention, the one or more scoring blades, designated 84, are driven by a servo motor 86, in the illustrated embodiment via a drive gear 88, an idler gear 90, and a driven gear 92 joined to a blade carrier 94 on which the scoring blades 84 are mounted. The gear train and blade carrier are rotatably mounted on a support plate 96, which in turn is movable with respect to the axis of the shaft of the servo motor 86. The support plate 96 can move relative to carousel 34 from its operative position, shown in FIG. 5, to an inoperative position, through approximately 90° by manipulation of handle 98. Suitable detent mechanisms 100 (FIG. 6) releasably retain the support plate in either of these two positions.

The servo motor driven motion of the scoring blades is controlled electronically so that it follows, as closely as practical, the initial entry point of each of the blades during the scoring interval and so that the tip of each blade always enters the closure at the intended entry point. The blade motion is synchronized with the motion of the carousel 34, which is measured and fed back to the motion control electronics for the servo motor 86 by an angle transducer (such as an encoder or resolver) coupled to the carousel 34. The motion control function should be capable of implementing piecewise cams in order to approximate the curves of FIG. 8, which is a plot of blade angular speed during scoring.

| | |
|---|---|
| $R_{cap} = .6275$ in. | Cap Radius |
| $R = 15$ in | Radius of Mandrel/Cap Center on Carousel |
| $G = 12.5$ | Gear Ratio: Cap-to-Carousel Ratio |
| Theta – 1.5782 deg | Carousel Angle at Blade Initial Contact (Choose for desired $D_{pt}$) |
| $Dpt = R \times \left[ \frac{\sin(ThetaxG)}{\sin(Thetax(G-1))} \times \left[ \frac{\sin(Theta)}{\sin(ThetaxG)} - 1 \right] + 1 \right]$ | Depth of Score |
| $D_{pt} = 0.0725$ in. | Depth of Score |
| $R_{cc} = R \times \frac{\sin(ThetaxG)}{\sin(Thetax(G-1))}$ | Radius of Cutter Pivot Point |
| $R_{cc} = 16.2540$ in. | Radius of Cutter Pivot Point |
| $R_{cut} = R_{cc} - R + D_{pt} - R_{cap}$ | Radius of Scoring Blade |
| $R_{cut} = 0.699$ in. | Radius of Scoring Blade |

During portions of the scoring cycle other than the scoring interval, the scoring blade may move forward to bring the next blade into engagement with the next cap, or if there is only one blade, the blade may be reversed, moved backward, and then reversed again to engage the next cap. That is, the blade can be operated to oscillate. As will be appreciated, in such an arrangement wherein the blade oscillates, the motion can also be generated without a servo motor, but by alternately employing a cam-and-lever arrangement.

It is presently preferred to employ a plurality of blades to minimize, to the extent possible, acceleration and deceleration of the blades, to thereby minimize heating of servo motor 86. While a scoring mechanism embodying the principles of the present invention can employ a purely mechanical drive (without an electronically controlled, servo motor), the preferred variable speed operation during each scoring interval allows the scoring action to most closely approximate the ideal radial blade movement. It is within the purview of the present invention that a common drive be employed for the carousel 34 as well as for the rotatably driven scoring blades.

The following analysis shows the manner in which a current embodiment of the present invention was configured to achieve a depth of score, $D_{pt}$ as desired. $R_{cap}$ is equal to the radius of the closure cap, R is equal to the radius of the center of the mandrel/closure cap on the carousel 34, and G is equal to the ratio of the closure rotation (about its axis) to carousel rotation.

The radius of the carousel, R, and the gear ratio, G, will have been determined from machine design considerations, the horizontal scoring requirements for the specific closure, and the specific features of the closure which may dictate positioning of the vertical score (such as the provision and number of container-engaging projections 22).

In the following calculation, the value of Theta is first determined, but rather than attempting to directly solve for Theta as a function of R, G, $D_{pt}$, the value of Theta that results in the desired $D_{pt}$ is determined by computing $D_{pt}$ using successive trial values of Theta. Once Theta has been determined, $R_{cc}$ (the distance from the center of the carousel to the blade's pivot point or axis) is a calculatable function of Theta, R, and G. Next, $R_{cut}$ is calculated, the radius of the scoring blade, which is a calculable function of $R_{cc}$, R, $D_{pt}$, and $R_{cap}$.

Figure 8:
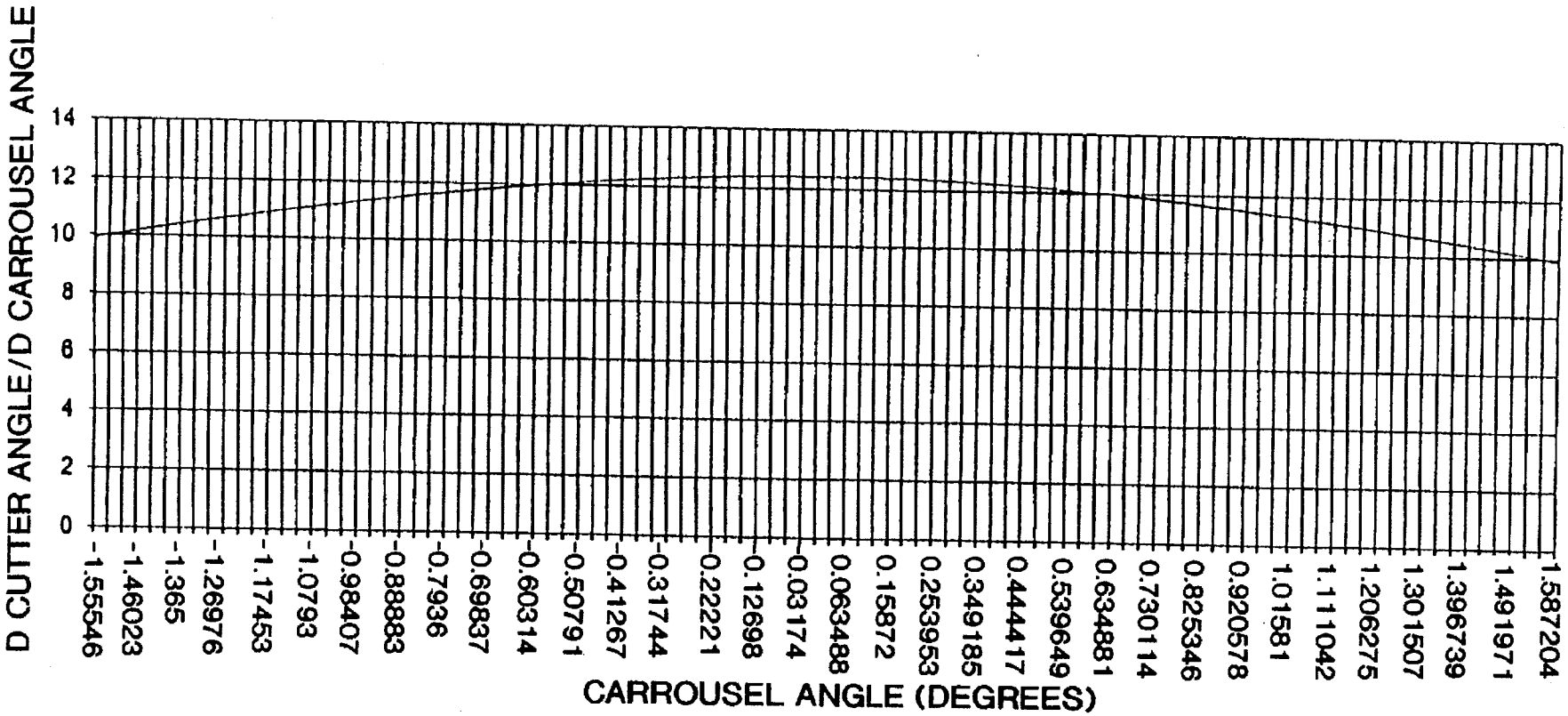
FIG. 8 is a graphical representation of the relationship of the position of the carousel and the speed of the scoring mechanism of the present invention.

Calculations have shown that the correct value for $R_{cc}$ is the one which produces symmetry of the initial entry point of the cutting blade and the final exit point of the blade about the centerline, and that the symmetrical case produces the minimum "digging" of the plastic closure by the blade. In the symmetrical case, when the center of the cap lies on the center line (between the carousel center axis and blade pivot or axis), so do the initial entry point on the cap and the blade. For this to be true, Beta, in FIG. 7, must equal Theta *G. FIG. 8 is a plot of blade angular speed during scoring. As will be observed, the rotatably driven scoring blade is accelerated, approximately 20%, then decelerated during the scoring interval.

From the foregoing, it will be observed that numerous modifications and variations can be effected without departing from the true spirit and scope of the novel concept of the present invention. It will be understood that no limitation with respect to the specific embodiment illustrated herein is intended or should be inferred. The disclosure is intended to cover, by the appended claims, all such modifications as fall within the scope of the claims.

What is claimed is:

1. A method of scoring a tamper-indicating plastic closure having a vertical axis, comprising the steps of:

providing a plastic closure having a top wall portion, a depending annular skirt portion, and an annular pilfer band;

providing a closure scoring apparatus including at least one mandrel;

positioning said closure in operative association with said mandrel;

moving said mandrel and said closure relative to scoring means of said scoring apparatus; and scoring said closure with knife means of said scoring means, by driving said knife means about a rotation axis generally parallel to the vertical axis of the closure to move said knife means with said closure as said closure is moved relative to said scoring means, including varying the speed of movement of said knife means during scoring of said closure.

2. A method of scoring a tamper-indicating plastic closure in accordance with claim 1, wherein said scoring step includes moving said knife means into said closure generally along a line which intersects the vertical axis of the closure.

3. A method of scoring a tamper-indicating plastic closure in accordance with claim 1, wherein said moving step includes rotating said mandrel and said closure about a rotational axis of said scoring apparatus which said rotational axis is spaced from said mandrel, and simultaneously rotating said mandrel and said closure about said vertical axis of the closure.

4. A method of scoring a tamper-indicating plastic closure in accordance with claim 3, wherein said scoring step includes driving said knife means to move about said rotation axis defined by the intersection of: (1) a first line extending through the vertical axis of the closure and a portion of said pilfer band of said closure at which said knife means first engages said closure, and (2) a second line extending through the vertical axis of the closure and said portion of said pilfer band when said knife means disengages said closure at the completion of said scoring step.

5. A method of scoring a tamper-indicating plastic closure, comprising the steps of:

providing a plastic closure having a top wall portion, a depending annular skirt portion and an annular pilfer band;

providing a closure scoring apparatus including a rotatable carousel, at least one mandrel carried by said carousel, and drive means connected to said mandrel so that rotation of said mandrel with said carousel causes said mandrel to further rotate about its own vertical axis with respect to the carousel;

positioning said closure in operative association with said mandrel;

rotating said carousel so that said closure and said mandrel rotate therewith, and further rotate about said vertical axis of said mandrel, including moving said mandrel and said closure relative to scoring means of said scoring apparatus; and scoring said pilfer band of said closure with knife means of said scoring means, by driving said knife means to move with said closure as said closure is moved relative to said scoring means, said scoring step including rotatably driving said knife means about a scoring axis, and moving said knife means into said closure generally along a line which intersects the vertical axis of the closure, and varying the speed at which said knife means is rotatably driven so that said knife means moves into, and is withdrawn from, said closure generally along said line as said closure is moved relative to said scoring means.

6. A method of scoring a tamper-indicating plastic closure, comprising the steps of:

providing a plastic closure having a top wall portion, a depending annular skirt portion and an annular pilfer band;

providing a closure scoring apparatus including a rotatable carousel, at least one mandrel carried by said carousel, and drive means connected to said mandrel so that rotation of said mandrel with said carousel causes said mandrel to further rotate about its own vertical axis with respect to the carousel;

positioning said closure in operative association with said mandrel;

rotating said carousel so that said closure and said mandrel rotate therewith, and further rotate about said vertical axis of said mandrel, including moving said mandrel and said closure relative to scoring means of said scoring apparatus; and scoring said pilfer band of said closure with knife means of said scoring means, by driving said knife means to move with said closure as said closure is moved relative to said scoring means, said scoring step including rotatably driving said knife means about a scoring axis and accelerating then decelerating said rotatably driven knife means.

* * * * *